US009301042B2

(12) United States Patent
Akino

(10) Patent No.: US 9,301,042 B2
(45) Date of Patent: Mar. 29, 2016

(54) ELECTRO-ACOUSTIC TRANSDUCER

(71) Applicant: Hiroshi Akino, Tokyo (JP)

(72) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 315 days.

(21) Appl. No.: 13/774,194

(22) Filed: Feb. 22, 2013

(65) Prior Publication Data

US 2013/0223647 A1 Aug. 29, 2013

(30) Foreign Application Priority Data

Feb. 24, 2012 (JP) ..... 2012-038742

(51) Int. Cl.
*H04R 25/00* (2006.01)
*H04R 1/22* (2006.01)
*H04R 23/00* (2006.01)

(52) U.S. Cl.
CPC ..... *H04R 1/22* (2013.01); *H04R 23/004* (2013.01)

(58) Field of Classification Search
CPC ..... H04R 23/00; H04R 23/004
USPC ..... 381/167
See application file for complete search history.

(56) References Cited

U.S. PATENT DOCUMENTS 4,482,788 A 11/1984 Klein

FOREIGN PATENT DOCUMENTS

EP 2397683 A1 * 12/2011
JP 2011-188037 9/2011

* cited by examiner

*Primary Examiner* — Matthew Eason
*Assistant Examiner* — Sean H Nguyen
(74) *Attorney, Agent, or Firm* — Whitham, Curtis, Christofferson & Cook, P.C.

(57) ABSTRACT

An electro-acoustic transducer includes a needle electrode, an opposite electrode, a discharge region between the needle electrode and the opposite electrode, a high-frequency oscillating circuit in the discharge region causing a high-frequency discharge and modulating and extracting an audio signal in accordance with a sound wave introduced to the discharge region, or converting the discharge in the discharge region into a sound wave, the discharge being performed in accordance with a high-frequency signal modulated by an audio signal, and an inert gas supply channel that supplies inert gas toward the peripheral surface of the needle electrode. The electro-acoustic transducer includes a needle-electrode cover as a part of the inert gas supply channel. The needle-electrode cover extends beyond the tip of the needle electrode toward the opposite electrode and has a gas flow outlet disposed beyond the tip of the needle electrode toward the opposite electrode.

11 Claims, 2 Drawing Sheets

ELECTRO-ACOUSTIC TRANSDUCER

TECHNICAL FIELD

The present invention relates to an electro-acoustic transducer that eliminates the use of a diaphragm by performing electro-acoustic transduction that involves high-frequency discharge. More specifically, the present invention can effectively prevent wear of the tip of a needle electrode and reduce wind noise.

BACKGROUND ART

A typical electro-acoustic transducer such as a microphone or speaker includes a diaphragm. A typical microphone receives vibrations of a diaphragm in response to sound waves as electromagnetic changes, changes in capacitance, or optical changes, which are then converted into electrical signals. A typical speaker electromagnetically converts audio signals into vibrations of a diaphragm to output sound waves.

The diaphragms in these electro-acoustic transducers are used for mutual conversion between aerial vibrations and electrical signals. In other words, the electro-acoustic transducer has a diaphragm that connects audio, mechanical vibration, and electrical circuit systems. Such a diaphragm for the mutual conversion in any type of conventional and typical electro-acoustic transducers may cause poor frequency responses.

Thus, the inertial force due to the mass of the diaphragm, even of an extremely minimized one, in the conventional electro-acoustic transducer may result in a poor frequency-based sound collection.

An example electro-acoustic transducer having no diaphragm and detecting a particle speed by utilizing electric discharge to perform electro-acoustic transduction is disclosed in Japanese Patent Application Laid-Open No. 55-140400 (Patent Literature 1). The transducer described in Patent Literature 1 includes a needle discharge electrode and an opposite electrode surrounding the discharge electrode, the opposite electrode being apart from the discharge electrode. The opposite electrode is composed of a spherical conductive material having punched pores to propagate sound waves therethrough. The discharge electrode extends towards the center of the spherical opposite electrode. A high-frequency voltage signal is applied from a high-frequency voltage generating circuit to the discharge electrode, the high-frequency voltage signal being modulated with a low-frequency signal which is to be converted into sound waves. The high-frequency voltage signal causes a corona discharge between the discharge electrode and the opposite electrode, which emits the low-frequency signal, i.e., a sound wave.

The transducer described in Patent Literature 1 is an ion speaker, which converts an electrical audio signal into a sound wave using electrical discharge. The ion speaker described in Patent Literature 1 cannot be used as a microphone, and such a use is not suggested.

The present inventor has invented a microphone that includes a needle electrode; an opposite electrode facing the needle electrode; a discharge region defined between the needle electrode and the opposite electrode; a high-frequency oscillating circuit that includes the discharge region, the high-frequency oscillating circuit causing high-frequency discharge in the discharge region; a sound wave introducer that introduces a sound wave to the discharge region; and a modulated signal extractor that extracts a signal modulated in accordance with the sound wave which is generated in the high-frequency oscillating circuit and introduced to the discharge region.

The electro-acoustic transducer or microphone, which involves high-frequency discharge, generates a non-uniform electric field between the needle electrode and the plate electrode and applies a high-frequency high voltage to the non-uniform electric field to form plasma. The plasma is generated in the vicinity of the needle electrode in a high electric field and extends towards the plate electrode. The needle electrode in contact with the plasma is in a high temperature, which wears the tip of the needle electrode of the electro-acoustic transducer and leaves corona products at or near the tip. This results in deterioration of discharging characteristics, for example, a plasma length or shape. The deteriorated discharging characteristics cause an abnormal discharge, which results in a defect, such as an abnormal sound wave from the discharging region.

The present inventor has presumed that the substance in the air causes corona products at or near the tip of the needle electrode, and filed a patent application for an electro-acoustic transducer involving high-frequency discharge, the electro-acoustic transducer including a channel that supplies inert gas toward the perimeter of the needle electrode to prevent wear of the tip of the needle electrode and adhesion of corona products, and abnormal discharge during a continuous high-frequency discharge (See Japanese Patent Application Laid-Open No. 2011-188037).

An example configuration of the electro-acoustic transducer described in Patent Literature 2 is shown in FIG. 2. FIG. 2 illustrates a microphone unit 20 including a needle electrode 23 and an opposite electrode 24 to cause discharge therebetween. The needle electrode 23 has a cylindrical base which is covered by an insulating cylinder 26. The insulating cylinder 26 is further fit to an insulating cylinder 25. The insulating cylinder 25 is fit to a base 21 while penetrating therethrough in the width direction thereof. In other words, the base of the needle electrode 23 is fixed to the base 21 through the insulating cylinders 25, 26, while penetrating through the base 21 in the width direction thereof.

The base 21 corresponds to the bottom of a cylindrical case 22. The case 22 includes a flange at the perimeter of the open end. The tip of the needle electrode 23 is formed into a cone shape with a sharp end. The tip of the needle electrode 23 extends substantially coaxially with the case 22 and is located within the space defined by the case 22. The needle electrode 23 may be composed of tungsten having a tip curvature of 50 μm.

An opposite electrode 24 covers the open end of the case 22, the open end being opposite to the base 21, which corresponds to the bottom of the case 22. The opposite electrode 24 is a plain electrode. The opposite electrode 24 is composed of, for example, a punched metal sheet having numerous pores or a conductive wire net so as to propagate sound waves therethrough. The opposite electrode 24 is covered with an insulating material. The opposite electrode 24 may be composed of, for example, a stainless steel sheet having a lot of pores to propagate sound waves therethrough, the stainless steel sheet being covered with ceramic (silica) having a thickness of 0.1 mm.

The opposite electrode 24 faces the tip of the needle electrode 23 at a certain distance therebetween, and the opposite electrode 24 and the needle electrode 23 define a discharging region. The discharging region, in which high-frequency discharge is generated, is included in a high-frequency oscillating circuit. The discharge or the torch discharge generates a torch flame 27. The opposite electrode 24 defines a sound wave introducing region that introduces sound waves into the discharging region in the case 22 as described above. The peripheral wall of the case 22 may have pores to introduce sound waves to the discharging region in the case 22.

To cause a high-frequency discharge between the needle electrode 23 and the opposite electrode 24, a high-frequency high voltage needs to be applied thereto. The high-frequency oscillating circuit thus has a vacuum tube as an active oscillating element, the vacuum tube being capable of withstanding a high voltage. The high-frequency oscillating circuit is configured such that the discharged current running through an electrical discharge channel between the needle electrode 23 and the opposite electrode 24 returns to the circuit. In other words, a high-frequency self-oscillating circuit is formed.

The needle electrode 23 and the opposite electrode 24 define a high-frequency discharge region. The particle speed in the high-frequency discharge region depends on the particle speed of a sound wave, and thereby equivalent impedance changes. The equivalent impedance in the high-frequency discharge region depending on a sound wave allows a signal from the high-frequency oscillating circuit to be modulated by the sound wave. The modulated signal includes frequency modulated (FM) components and amplitude modulated (AM) components, the number of the FM components being larger than that of the AM components. The FM signal is extracted and input to a frequency demodulating circuit to be converted into an audio signal in response to the sound wave from the sound wave introducing region.

The needle electrode 23 is surrounded by an inert gas guide channel 251 up to the vicinity of the tip thereof. The inert gas guide channel 251 is provided to carry the inert gas along the peripheral surface of the needle electrode in the electro-acoustic transducer. The inert gas guide 251 is composed of a cylindrical insulating material, the 251 being integrated with the insulating cylinder 25 that holds the peripheral surface of the insulating cylinder 26, the insulating cylinder 26 supporting the needle electrode 23. The inert gas guide 251 surrounds the needle electrode 23 with a space therebetween, and includes a gas flow outlet 252 through which the inert gas flows along the peripheral surface of the tip of the needle electrode 23. The tip of the needle electrode 23 extends through the gas flow outlet 252, which achieves the discharge between the needle electrode 23 and the opposite electrode 24.

The inert gas guide channel 251 is in communication with a pipe 42. The pipe 42 is fixed to the cylindrical case 22 while extending therethrough in the radial direction. A first end of the pipe 42 is fit to the inert gas guide 251. This configuration allows the internal space of the pipe 42 to be in communication with the inert gas guide channel 251.

A second end of the pipe 42 resides outside the case 22 and is connected through a coupling 41 to a pipe 40. In addition to the above-mentioned inert gas guide channel 251, the pipe 40, coupling 41, and pipe 42 define an inert gas supply channel from a gas cylinder (not shown) to the needle electrode 23 of the microphone unit 20 or the electro-acoustic transducer. Example inert gases used include helium or nitrogen gas.

The technique in Patent Literature 2 causes a high-frequency discharge between the needle electrode 23 and the opposite electrode 24 to achieve electro-acoustic transduction, while inert gas is supplied from the inert gas supply channel. The inert gas introduced through a supply channel including the pipe 40, the coupling 41, and the pipe 42 into the inert gas guide channel 251 flows through the inert gas guide channel 251 to the gas flow outlet 252. The inert gas focused through the gas flow outlet 252 flows along the perimeter of the tip of the needle electrode 23, which prevents the perimeter of the needle electrode 23 from contacting with air.

The technique in Patent Literature 2 can prevent corona products resulting from substance in air from adhering to the needle electrode 23. The technique in Patent Literature 2 can prevent an abnormal discharge caused by the corona product adhered to the needle electrode 23, thereby obtaining an electro-acoustic transducer involving a stable high-frequency discharge. The technique in Patent Literature 2 can also prevent wear of the tip of the needle electrode due to an air flow, which has not been achieved by the conventional technique.

SUMMARY OF INVENTION

Technical Problem

The electro-acoustic transducer involving high-frequency discharge, which is shown in FIG. 2, supplies inert gas from the inert gas supply channel to the peripheral surface of the needle electrode during the discharge between the needle electrode 23 and the opposite electrode 24. Such an electro-acoustic transducer can prevent the surface of the needle electrode 23 from contacting with air and corona products resulting from substance in air from adhering to the needle electrode. Thus, the electro-acoustic transducer shown in FIG. 2 can prevent an abnormal discharge caused by the adhesion of the corona products.

The technical development for enhancement of the performance of the above-mentioned electro-acoustic transducer involving high-frequency discharge suggests the need of a further improvement in the performance characteristics of the electro-acoustic transducer. One of the performance characteristics to be improved is sensitivity. One countermeasure to enhance the sensitivity of the electro-acoustic transducer involving high-frequency discharge is an increased power of discharge.

Unfortunately, the increased power of discharge in the electro-acoustic transducer involving high-frequency discharge readily causes a spark discharge. To prevent such a spark discharge, the flow rate of the inert gas may be increased; however, the increased flow of the inert gas blows the plasma, which causes noise similar to the wind noise that is commonly observed in microphones, thereby deteriorating a signal-to-noise ratio.

Accordingly, an object of the present invention is to solve the problem of the conventional electro-acoustic transducer involving high-frequency discharge, that is, to provide an electro-acoustic transducer involving high-frequency discharge that can enhance the sensitivity while preventing wind noise.

Solution to Problem

An electro-acoustic transducer according to the present invention includes a needle electrode, an opposite electrode facing the needle electrode, a discharging region between the needle electrode and the opposite electrode, a high-frequency oscillating circuit that includes the discharging region, the high-frequency oscillating circuit causing a high-frequency discharge in the discharging region and modulating and extracting an audio signal in accordance with a sound wave introduced to the discharging region, or converting discharge in the discharging region into a sound wave, the discharge being performed in accordance with a high-frequency signal modulated by an audio signal, and an inert gas supply channel that supplies inert gas toward the peripheral surface of the needle electrode, wherein the inert gas supply channel includes a needle-electrode cover that covers the peripheral surface of the needle electrode, and the needle-electrode cover extends beyond the tip of the needle electrode toward the opposite electrode and has a gas flow outlet disposed beyond the tip of the needle electrode toward the opposite electrode.

Advantageous Effect of Invention

The electro-acoustic transducer according to the present invention can effectively prevent a spark discharge even at a low flow rate of inert gas and with an increased power of discharge, and thus can reduce wind noise while enhancing the sensitivity and improving a signal-to-noise ratio.

DESCRIPTION OF EMBODIMENTS

Embodiment

Figure 1:
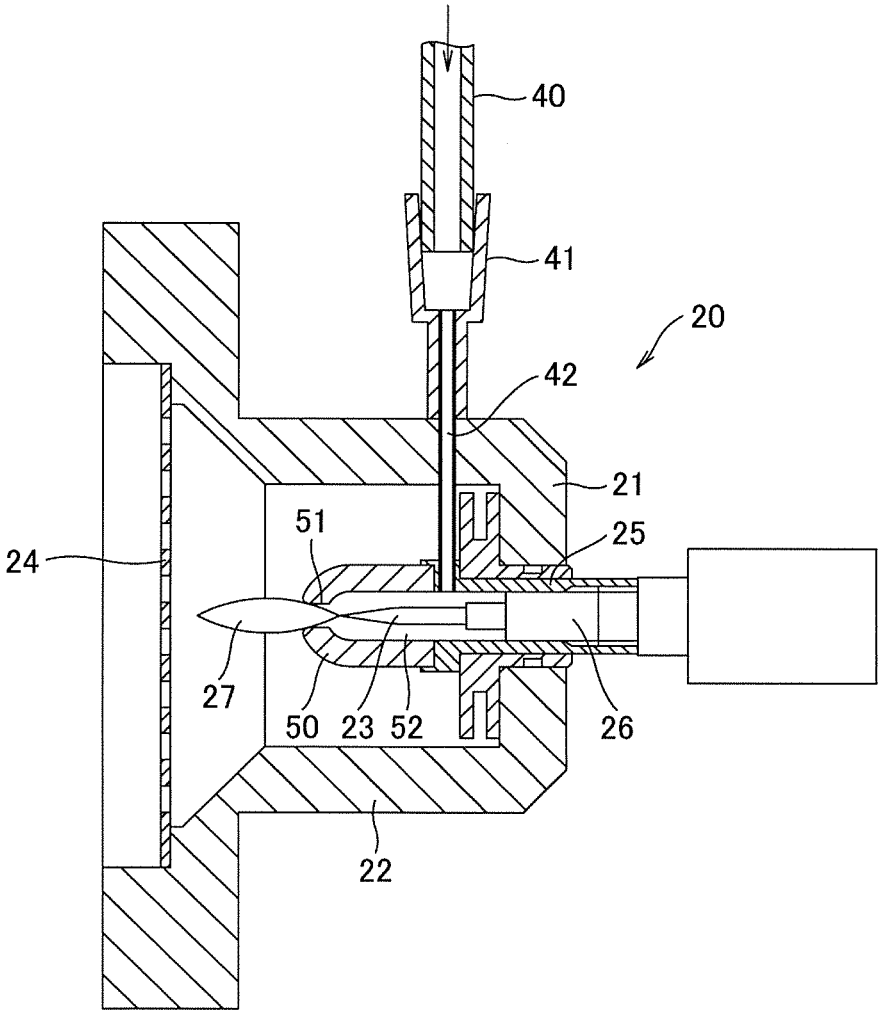
FIG. 1 is a longitudinal sectional view showing an embodiment of the electro-acoustic transducer in accordance with the present invention.
Figure 2:
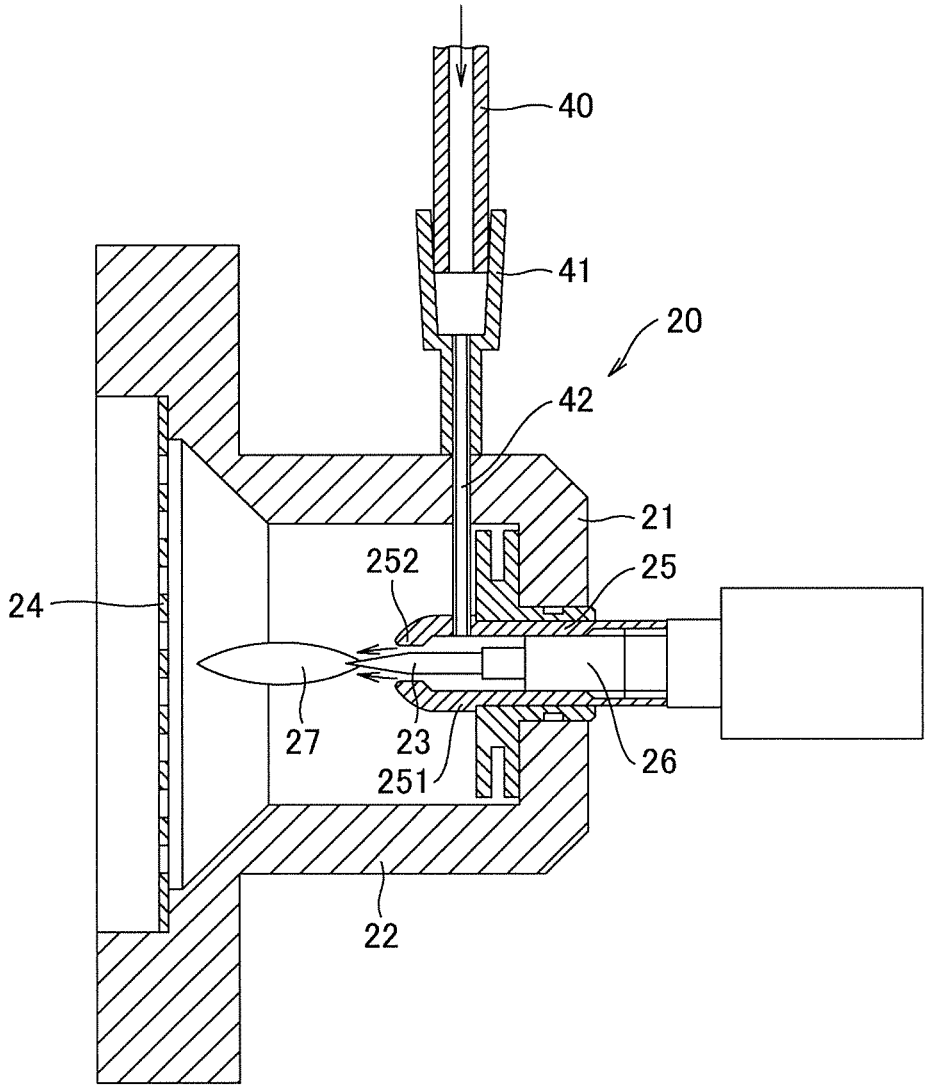
FIG. 2 (Related Art)
FIG. 2 is a longitudinal sectional view showing an example embodiment of the conventional electro-acoustic transducer involving high-frequency discharge.

With reference to FIG. 1, an embodiment of the electro-acoustic transducer in accordance with the present invention will now be described. Many components common between the electro-acoustic transducer shown in FIG. 1 and the conventional electro-acoustic transducer shown in FIG. 2 are denoted by the same reference numerals.

In FIG. 1, a microphone unit 20 includes a needle electrode 23 and an opposite electrode 24 to cause discharge therebetween. The needle electrode 23 has a cylindrical base. The peripheral surface of the base is covered with an insulating cylinder 26. The insulating cylinder 26 is further fit to an insulating cylinder 25. The insulating cylinder 25 is fixed to a base 21 while extending therethrough in the thick direction. In other words, the base of the needle electrode 23 is fixed to the base 21 via the insulating cylinders 25, 26 while extending through the base 21 in the thickness direction. A cylindrical case 22 extends from the outer perimeter of the base 21 while being integrated therewith. The base 21 corresponds to the bottom of the cylindrical case 22. The needle electrode 23 is located substantially coaxially with the case 22 and within the space defined by the case 22. The tip of the needle electrode 23 is formed in a cone shape and extends into the case 22. The tip of the needle electrode 23 has a sharp end. The needle electrode 23 may be composed of tungsten having a tip curvature of 50 μm.

An opposite electrode 24 covers the open end of the case 22, the open end being opposite to the base 21. The opposite electrode 24 is a plain electrode. The opposite electrode 24 is composed of, for example, punched metal sheet having numerous pores or a conductive wire net so as to propagate sound waves therethrough. The opposite electrode 24 is covered with an insulating material. The opposite electrode 24 may be composed of, for example, a stainless steel sheet having a lot of pores to propagate sound waves therethrough, the stainless steel sheet being covered with ceramic (silica) having a thickness of 0.1 mm.

The opposite electrode 24 faces the tip of the needle electrode 23 at a certain distance therebetween, and the opposite electrode 24 and the needle electrode 23 define a discharging region. The discharging region, which is included in a high-frequency oscillating circuit, causes high-frequency discharge. The discharge, i.e. the torch discharge, generates a torch flame 27 in the discharging region between the needle electrode 23 and the opposite electrode 24. The opposite electrode 24 defines a sound wave introducing region that introduces sound waves into the discharging region in the case 22 as described above. The peripheral wall of the case 22 may have pores to introduce sound waves into the discharging region in the case 22.

To cause high-frequency discharge between the needle electrode 23 and the opposite electrode 24, a high-frequency high voltage needs to be applied thereto. The high-frequency oscillating circuit thus has a vacuum tube as an active oscillating element, the vacuum tube being capable of withstanding a high voltage. The high-frequency oscillating circuit is configured such that the discharged current through an electrical discharge channel between the needle electrode 23 and the opposite electrode 24 returns to the circuit. In other words, a high-frequency self-oscillating circuit is formed.

The needle electrode 23 and the opposite electrode 24 define a high-frequency discharge region. The particle speed in the high-frequency discharge region depends on the particle speed of a sound wave, and thereby equivalent impedance changes. The equivalent impedance in the high-frequency discharge region depending on a sound wave allows a signal from the high-frequency oscillating circuit to be modulated by the sound wave. The modulated signal includes frequency modulated (FM) components and amplitude modulated (AM) components, the number of the FM components being larger than that of the AM components. The FM signal is extracted and input to a frequency demodulating circuit to be converted into an audio signal in response to the sound wave from the sound wave introducing region.

The frequency demodulating circuit functions as a modulating circuit if the electro-acoustic transducer in accordance with the present invention is a microphone. The microphone converts an audio signal into a sound wave by causing discharge in the discharge region in accordance with a high-frequency signal, the high-frequency signal being modulated by an audio signal. Thus, the modulating circuit performs conversion between a modulated signal (generated signal) and a sound wave.

The top of the insulating cylinder 25 resides inside the case 22 and is fit to the base of a needle-electrode cover 50. The needle-electrode cover 50, which extends beyond the tip of the needle electrode 23 toward the opposite electrode 24, has a gas flow outlet 51 disposed between the opposite electrode 24 and the tip of the needle electrode 23. Since the needle electrode 23 has a tapered tip, the gas flow outlet 51 has a small radius. The needle-electrode cover 50 is a cylindrical member, the internal space thereof defining an inert gas guide channel 52. Thus, the entire needle electrode 23 is surrounded by the inert gas guide channel 52 in the length direction.

The inert gas guide channel 52 is provided in the electro-acoustic transducer to carry inert gas along the peripheral surface of the needle electrode 23. The insulating cylinder 25 is integrated with the needle-electrode cover 50, the insulating cylinder 25 holding the peripheral surface of the insulating cylinder 26 to supports the needle electrode 23. The inert gas guide channel 52 extends along the needle electrode 23 to surround the needle electrode 23. A gas flow outlet 51 is disposed at the top of the needle-electrode cover 50. The inert gas along the perimeter surface of the tip portion of the needle electrode 23 flows through the gas flow outlet 51. The gas flow outlet 51 allows the needle electrode 23 to achieve discharge with the opposite electrode 24.

The inert gas guide channel 52 is in communication with a pipe 42. The pipe 42 is fixed to the cylindrical case 22 while extending through the cylindrical case 22 in the radial direction. A first end of the pipe 42 is fit to the insulating cylinder 25. This configuration allows the internal space of the pipe 42 to be in communication with the inert gas guide channel 52. A second end of the pipe 42 resides outside the case 22 is connected through a coupling 41 to a pipe 40. The pipe 40, coupling 41 and pipe 42 define an inert gas supply channel, which extends from a gas cylinder (not shown) to the microphone unit 20 or electro-acoustic transducer. In addition to the inert gas guide channel 52, the pipe 40, coupling 41, and pipe 42 define the inert gas supply channel Example inert gases used include helium or nitrogen gas.

The electro-acoustic transducer in accordance with the embodiment shown in FIG. 1 causes a high-frequency discharge between the needle electrode 23 and the opposite electrode 24 to achieve electro-acoustic transduction, while inert gas is supplied from the inert gas supply channel. The inert gas is supplied through the supply channel including the pipe 40, the coupling 41, and the pipe 42 into the inert gas guide channel 52 and then flows through the inert gas guide channel 52 defined by the needle-electrode cover 50 toward a gas flow outlet 51. The inert gas focused through the gas flow outlet 51 flows along the perimeter of the tip portion of the needle electrode 23, which prevents the perimeter of the tip of the needle electrode 23 from contacting with air.

The electro-acoustic transducer in accordance with the embodiment shown in FIG. 1 can prevent corona products resulting from substance in air from adhering to the needle electrode 23 and inhibits an abnormal discharge caused by the adhesion of the corona products, thereby providing a stable high-frequency discharge. The electro-acoustic transducer in accordance with the embodiment shown in FIG. 1 can also prevent wear of the tip portion of the needle electrode due to an air flow, which has not been achieved by the conventional technique.

During the operation of the exemplary electro-acoustic transducer shown in FIG. 1, the needle electrode 23 covered with the needle-electrode cover 50 is surrounded by the inert gas, thus does not contact with air. The electro-acoustic transducer in accordance with the embodiment shown in FIG. 1 can prevent the tip of the needle electrode 23 from defects, such as wear caused by discharge and adhesion of corona products. The electro-acoustic transducer in accordance with the embodiment shown in FIG. 1 thus can prevent an abnormal discharge caused by the corona products.

The needle-electrode cover 50, which defines the inert gas guide channel, extends beyond the tip of the needle electrode 23 toward the opposite electrode 24 and has the gas flow outlet 51 disposed between the opposite electrode 24 and the tip of the needle electrode 23. The exemplary electro-acoustic transducer having such a structure shown in FIG. 1 can effectively prevent a spark discharge even at a low flow rate of inert gas.

Thus, the electro-acoustic transducer in accordance with the embodiment shown in FIG. 1 can increase power of discharge to enhance the sensitivity while preventing a spark discharge by regulating an inert gas at a low flow rate, thereby reducing wind noise due to the inert gas flow to improve a signal-to-noise ratio.

The embodiment described above is a microphone including the electro-acoustic transducer of the present invention. The electro-acoustic transducer of the present invention can also be applied to an ionic loudspeaker. The electro-acoustic transducer in accordance with the present invention modulates a high-frequency signal, which is generated in the high-frequency oscillating circuit, into an audio signal in a modulating circuit, and causes discharge between the needle electrode 23 and the opposite electrode 24 using the modulated signal.

Thus, the electro-acoustic transducer in accordance with the present invention can be used as a microphone and a speaker.

What is claimed is:

1. An electro-acoustic transducer, comprising:

a needle electrode having a tapered tip;

an opposite electrode facing the needle electrode, the opposite electrode and the needle electrode defining a discharge region;

a high-frequency oscillating circuit that cause a torch flame by discharge in the discharge region in accordance with a high-frequency signal;

an inert gas supply channel that supplies inert gas toward a peripheral surface of the needle electrode; and a needle-electrode cover that covers the entire peripheral surface of the needle electrode in a length direction, wherein the electro-acoustic transducer converts a sound wave introduced to the discharge region into an audio signal by modulating and extracting a sound signal in accordance with the sound wave, wherein the needle-electrode cover extends beyond the tip of the needle electrode toward the opposite electrode and has a gas flow outlet disposed beyond the tip of the needle electrode toward the opposite electrode, wherein the gas flow outlet faces the opposite electrode and focuses the inert gas so that the inert gas flows along the perimeter of the tip portion of the needle electrode, wherein the torch flame passes through the gas flow outlet, and wherein a radius of the gas flow outlet is at least equal in size to a radius of the torch flame that occurs in the discharge region between the opposite electrode and the needle electrode.

2. The electro-acoustic transducer according to claim 1, wherein the needle-electrode cover is a cylindrical member comprising a base and a tip, the tip having a smaller radius than the base, and the internal space of the cylindrical member defines an inert gas guide channel to carry inert gas along the peripheral surface of the needle electrode.

3. The electro-acoustic transducer according to claim 1, wherein the inert gas guide is composed of an insulating material.

4. The electro-acoustic transducer according to claim 1, wherein the needle-electrode cover is integrated with an insulating material holding the peripheral surface of the needle electrode.

5. The electro-acoustic transducer according to claim 1, wherein the inert gas is helium gas.

6. The electro-acoustic transducer according to claim 1, wherein the inert gas is nitrogen gas.

7. An electro-acoustic transducer, comprising:

a needle electrode having a tapered tip;

an opposite electrode facing the needle electrode, the opposite electrode and the needle electrode defining a discharge region;

a high-frequency oscillating circuit that cause a torch flame by discharge in the discharge region in accordance with a high-frequency signal;

an inert gas supply channel that supplies inert gas toward a peripheral surface of the needle electrode; and a needle-electrode cover that covers the entire peripheral surface of the needle electrode in a length direction, wherein the electro-acoustic transducer converts an audio signal into a sound wave by causing discharge in the discharge region in accordance with a high-frequency signal, wherein the needle-electrode cover extends beyond the tip of the needle electrode toward the opposite electrode and has a gas flow outlet disposed beyond the tip of the needle electrode toward the opposite electrode, wherein the gas flow outlet faces the opposite electrode and focuses the inert gas so that the inert gas flows along the perimeter of the tip portion of the needle electrode, wherein the torch flame passes through the gas flow outlet, and wherein a radius of the gas flow outlet is at least equal in size to a radius of the torch flame that occurs in the discharge region between the opposite electrode and the needle electrode.

8. The electro-acoustic transducer according to claim 7, wherein the inert gas guide is composed of an insulating material.

9. The electro-acoustic transducer according to claim 7, wherein the needle-electrode cover is integrated with an insulating material holding the peripheral surface of the needle electrode.

10. The electro-acoustic transducer according to claim 7, wherein the inert gas is helium gas.

11. The electro-acoustic transducer according to claim 7, wherein the inert gas is nitrogen gas.

* * * * *